United States Patent [19]

Gevers

[11] 4,166,409

[45] Sep. 4, 1979

[54] SPORTING WEAPON

[75] Inventor: Georges A. Gevers, Liége, Belgium

[73] Assignee: Fabrique Nationale Herstal en abrégé FN, Herstal, Belgium

[21] Appl. No.: 834,667

[22] Filed: Sep. 19, 1977

[30] Foreign Application Priority Data

Sep. 6, 1977 [BE] Belgium ..... 56216

[51] Int. Cl.[2] ..... F41D 1/06; F41D 5/12

[52] U.S. Cl. ..... 89/128; 89/159; 89/173; 89/176; 89/191 R

[58] Field of Search ..... 89/128, 159, 176, 177, 89/178

[56] References Cited

U.S. PATENT DOCUMENTS

| | | | |
|---|---|---|---|
| 2,499,090 | 2/1950 | Browning | 89/176 |
| 2,570,772 | 10/1951 | Crittendon | 89/176 |
| 3,018,694 | 1/1962 | Browning | 89/159 |
| 3,110,222 | 11/1963 | Harvey | 89/159 |

*Primary Examiner*—Stephen C. Bentley

*Attorney, Agent, or Firm*—Bacon & Thomas

[57] ABSTRACT

Automatic or semi-automatic sporting weapon of the type with gas tapping, characterized by the fact that it is fitted with a floating barrel.

4 Claims, 16 Drawing Figures

Fig. 1
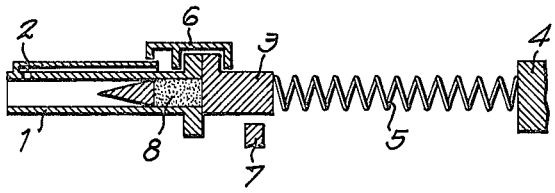
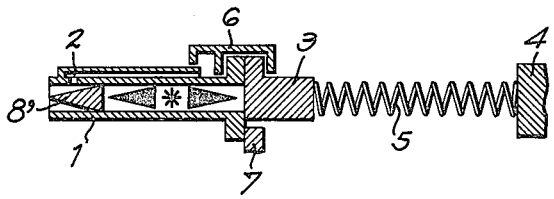
Fig. 2
Fig. 3
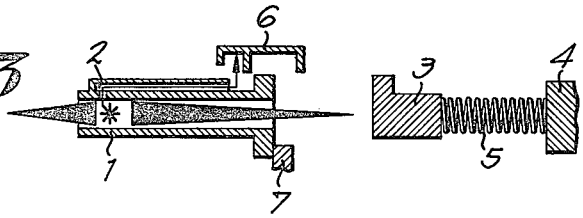
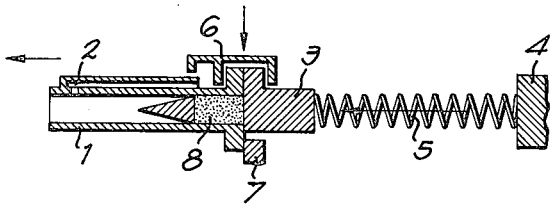
Fig. 4

SPORTING WEAPON

The present invention pertains to an improved sporting weapon of the automatic or semi-automatic type.

Since the end of last century, the problem of rendering certain fire-arms automatic has been studied practically in a continuous manner, more particularly for military purposes, but also in the sporting field.

Whereas the principles of the various known manners of automatic operation are relatively simple, the application thereof in practice is infinitely more delicate. This mainly explains the relatively slow evolution of military automatic arms, for instance.

The problem is more complicated still in the case of sporting guns because, contrary to the case of war arms, they are called upon to fire ammunition of widely differing power, while offering a maximum comfort to the shoulder when firing high power ammunition. This constitutes a further restraint, the ideal being of course that the weapon should operate comfortably and irreproachably with each of the ammunitions under consideration and consequently for all practices of shooting.

It is because of this restraint that in the course of the latter years, the automatic operation of sporting weapons has generally been based either on gas tapping, which permits a relieving of the recoil when firing high powered ammunition, or on the inertia principle, which is easily adjustable for the firing of cartridges of various powers.

Although automatic sporting weapons operating by means of a gas tapping have been offered which permit the firing of a wide range of ammunition, it has up till now not been possible to build a sporting weapon capable of firing the entire range of usual hunting and competition ammunition with sufficient guarantee of proper operation and of maximum comfort to the marksman when called upon to fire a large number of very high power cartridges within a very short space of time.

The purpose of the present invention is to eliminate or attenuate the respective disadvantages of the gas tapping and inertia systems, while retaining the respective advantages thereof, and such surprisingly by combining the two in one and the same weapon.

This purpose is reached, according to the invention, by fitting a sporting gun having a gas tapping with an axially floating barrel. By axially floating barrel it must be understood that the barrel is capable of carrying out an axial recoil when the shot is fired and of returning to its initial position under the combined effect of inertia and of the recocking if the weapon.

The weapon according to the invention may be provided with a system for selectively locking the floating barrel, which may be preferred for competition shooting or when a large number of rounds have to be fired.

In order better to emphasize the characteristics and the advantages of the invention, the principle thereof as well as two practical examples of constructions shall be described hereinafter in greater detail, with reference to the appended drawings in which:

FIGS. 1 to 4 schematically illustrate the operating principle of the invention;

Figure 5:
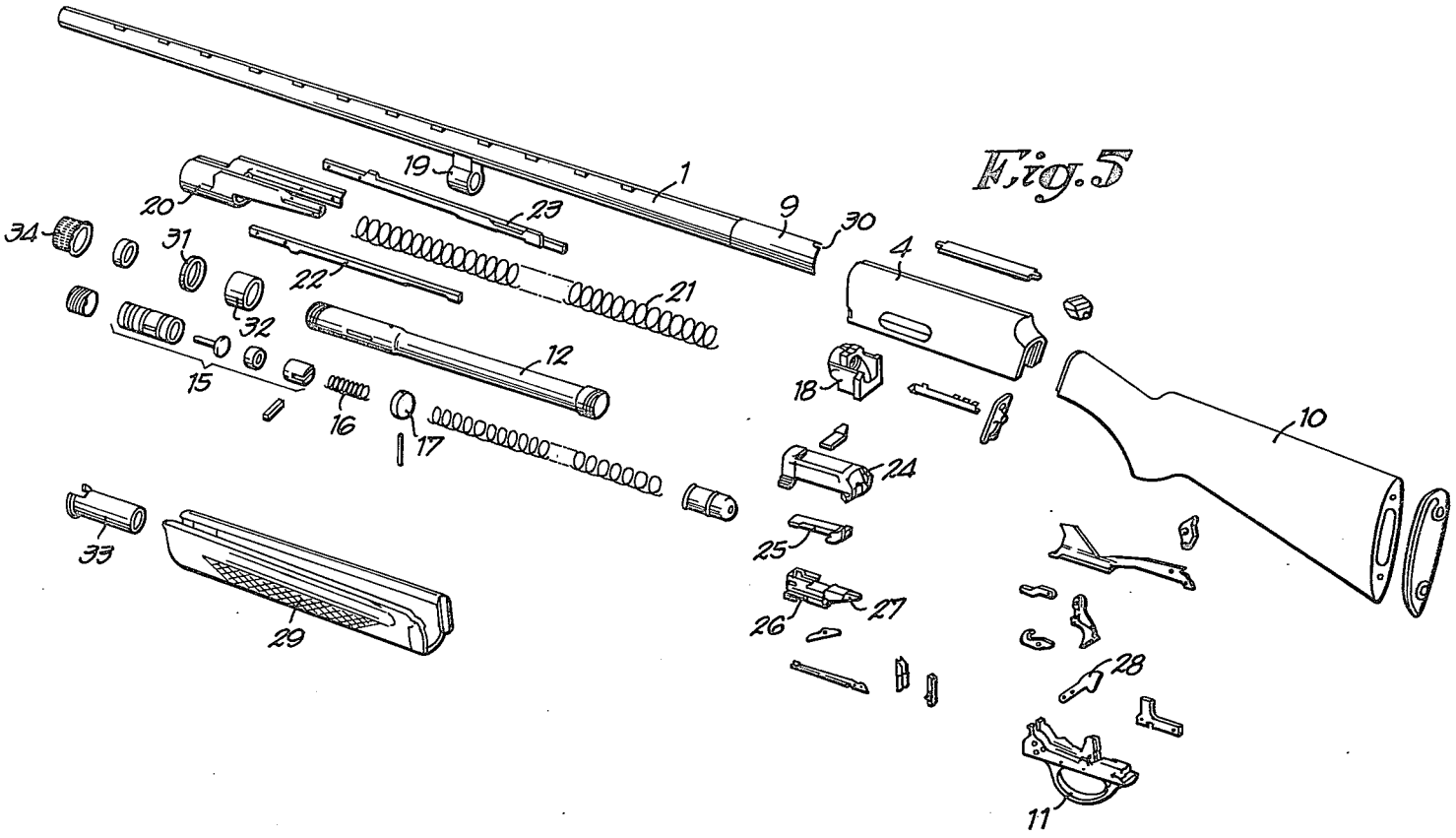
FIG. 5 is an exploded view of the main elements of a sporting gun according to the invention.
Figure 6:
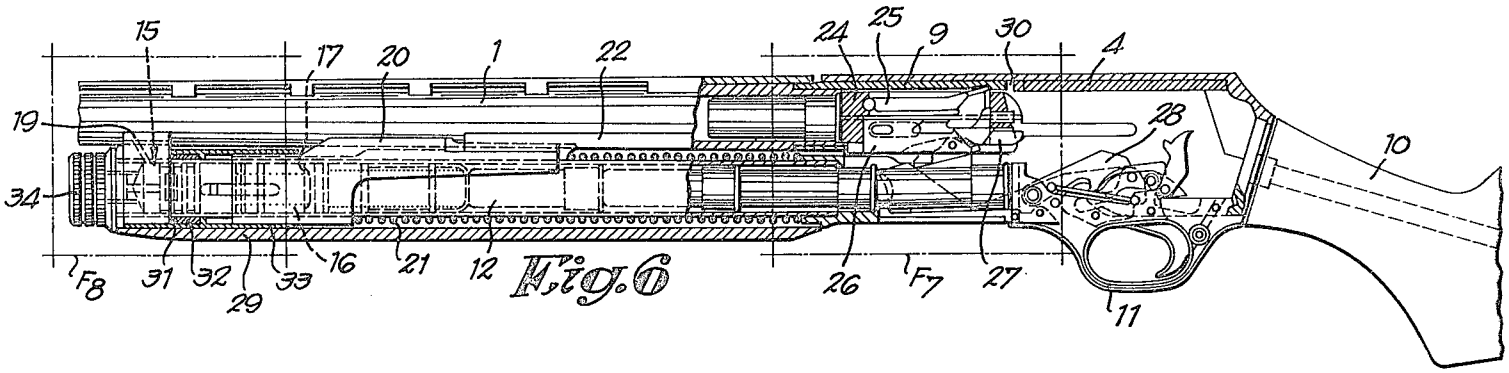
FIG. 6 is a partial axial section of the gun of FIG. 5, in assembled condition.
Figure 7:
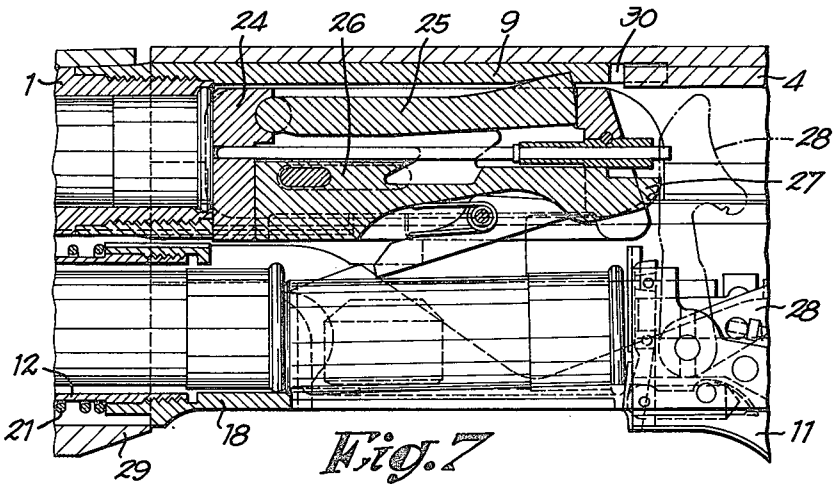
Figure 8:
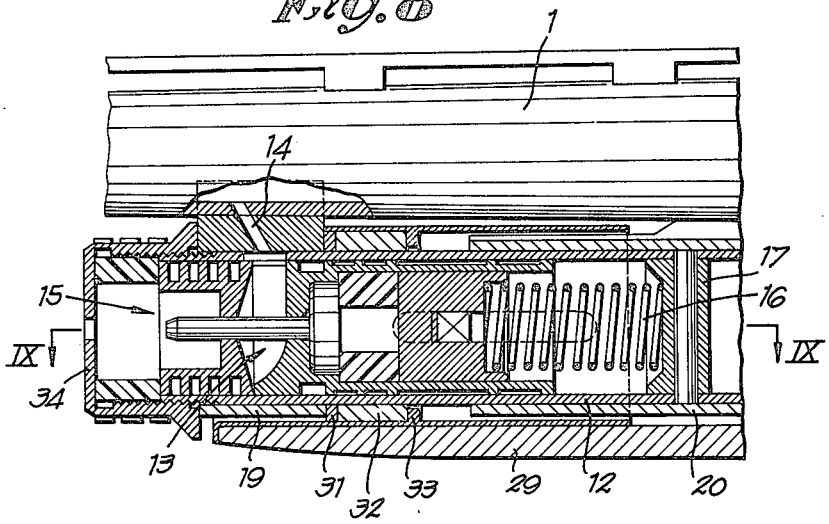
Figure 9:
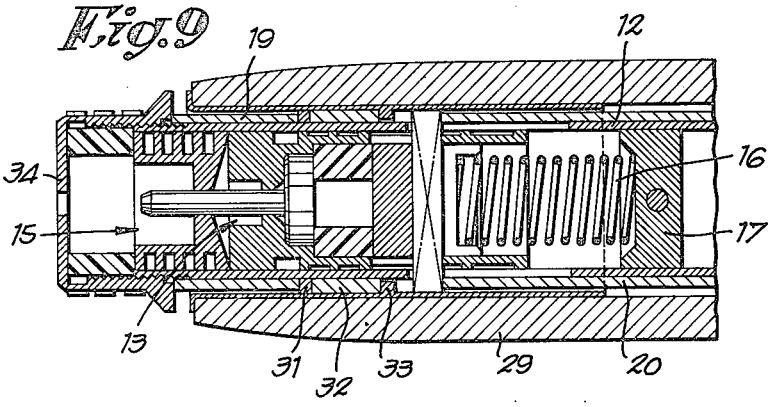
Figure 10:
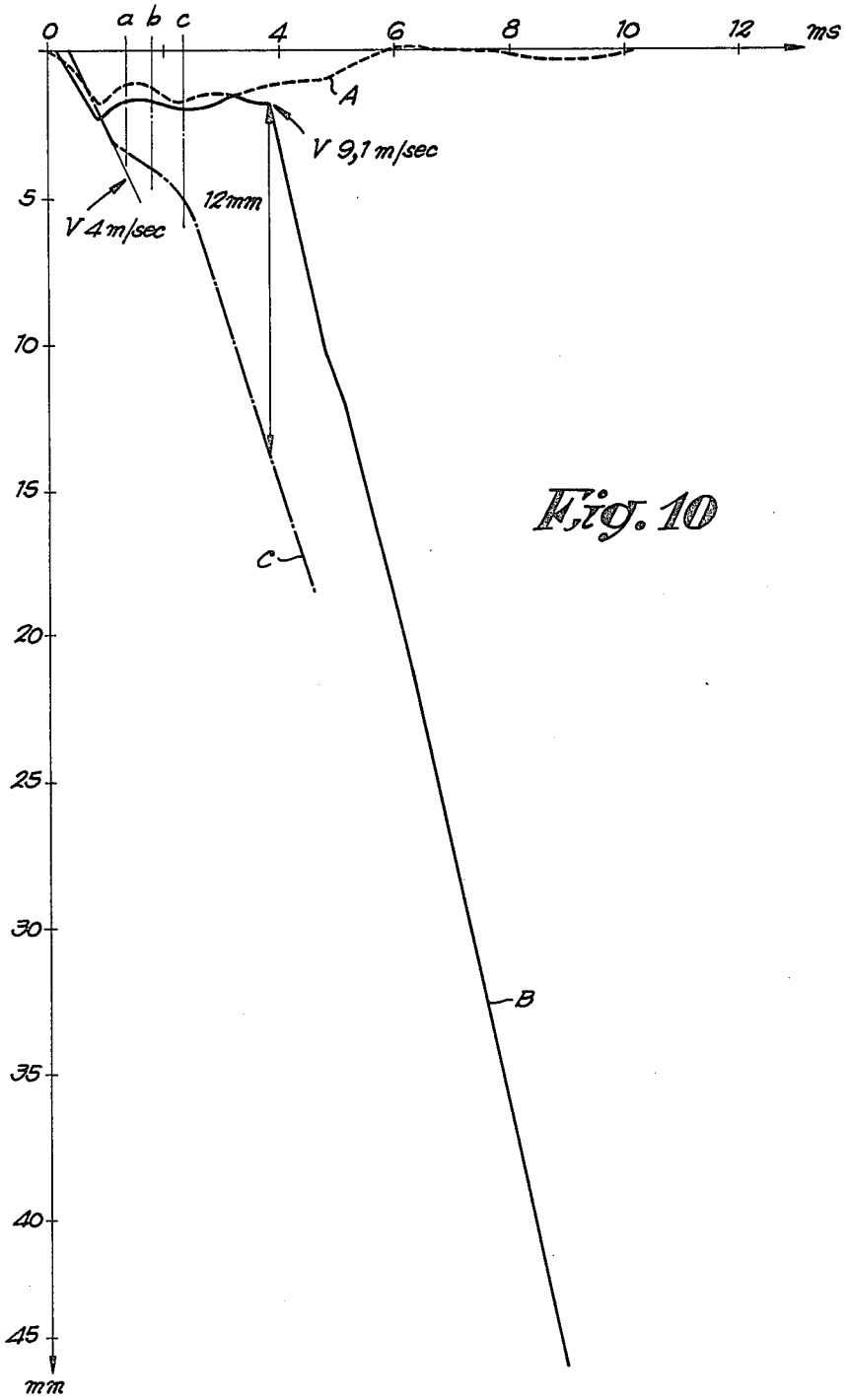
Figure 10:
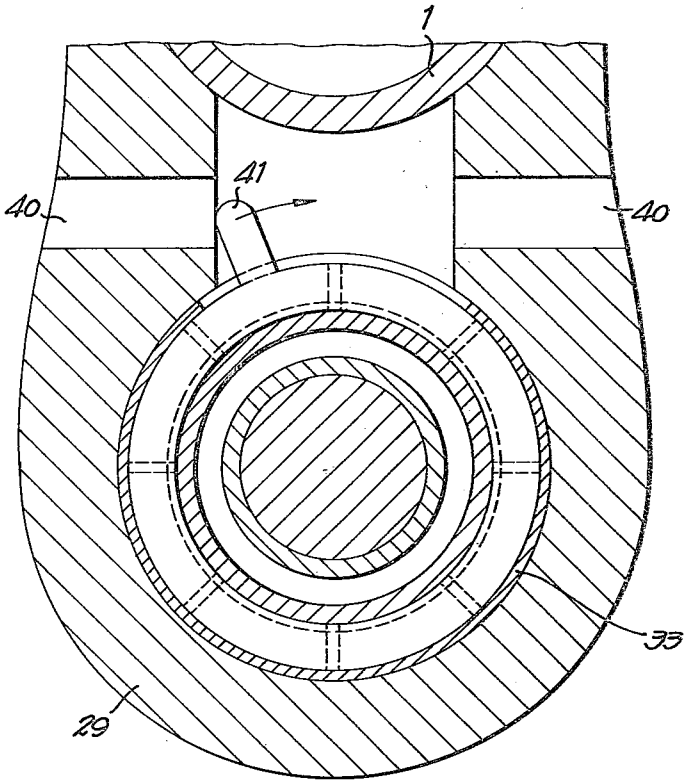
Figure 11:
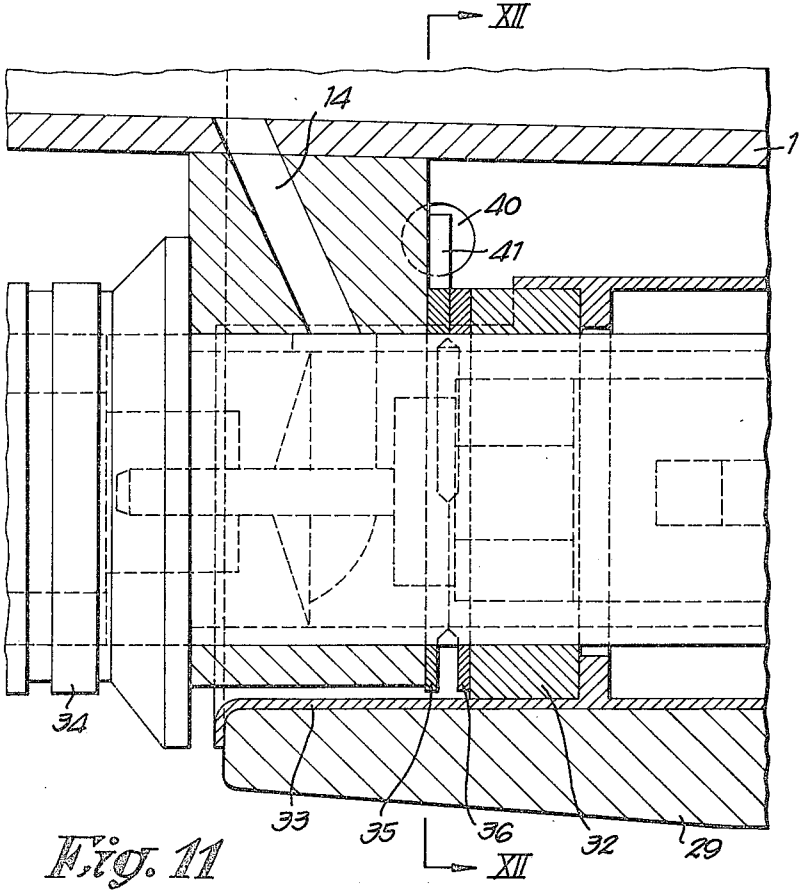
Figure 15:
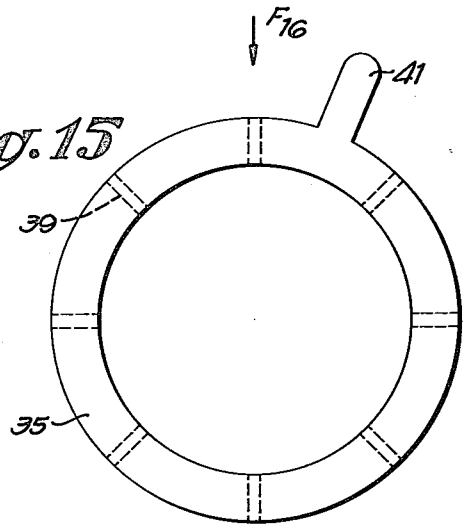
Figure 13:
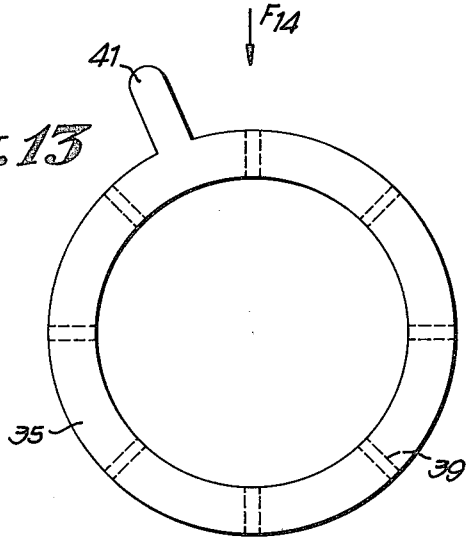
Figure 14:
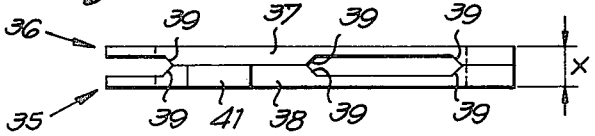

FIGS. 7 and 8 respectively show, to a larger scale, those parts indicated in FIG. 6 as F7 and F8;

FIG. 9 is a section along to line IX—IX in FIG. 8;

FIG. 10 is a time-travel graph, illustrating the operation and the advantages of the weapon according to FIGS. 5 to 9;

FIG. 11 shows, to a larger scale, the part indicated in FIG. 6 as F8, in a second form of embodiment namely a form which provides a locking system for the floating barrel;

FIG. 12 is a section along to line XII—XII in FIG. 11;

FIG. 13 shows the locking device of the floating barrel in unlocked position;

FIG. 14 is a view of this device as seen along arrow F14 in FIG. 13;

FIG. 15 shows the locking device of the floating barrel in locked position; and

Figure 16:
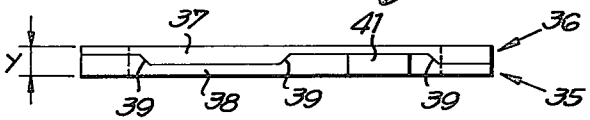

FIG. 16 is a view of this device as seen along arrow F16 in FIG. 15.

The weapon according to the invention comprises a barrel 1 with gas tapping 2, a mobile outfit 3 (such as for instance a moving breech and slide), a casing 4, a recuperating spring 5, a mobile lock which is capable of temporarily locking barrel 1 and mobile outfit 3, and a stop 7 in order to limit the recoil of barrel 1.

FIG. 1 shows the weapon ready to fire, a round of ammunition 8 being in the chamber of barrel 1. On firing the shot (FIG. 2) the entire assembly of barrel 1, mobile outfit 3 and lock 6 recoils until stopped against stop 7. The projectile 8' next uncovers the vent of the gas tapping system 2, which brings lock 6 into its unlocked position, thus freeing mobile outfit 3. The latter is pushed back towards the bottom of casing 4, thus compressing recuperating spring 5. During this movement of recoil, the mobile outfit assures the ejection if the shell of round of ammunition 8 (FIG. 3).

Mobile outfit 3 bounces back, is pressed forward by spring 5 and brings a new round of ammunition into the chamber of barrel 1. Lock 6 locks the mobile outfit to the barrel (FIG. 4) and the assembly completes the return movement so as to resume the initial position of FIG. 1. A sporting gun which operates according to the above-described principle is illustrated in FIGS. 5 to 9.

This gun comprises a barrel 1 with breech 9 fitted in casing 4. The latter is extended by the butt 10 and is fitted with a trigger guard 11. Below barrel 1 there is provided a magazine tube 12, extended towards the front by gas chamber 13, which is in communication by means of vent 14 (FIG. 8) with the bore of the barrel 1. In chamber 13, a double piston 15 is located which is stressed towards the front by a spring 16, which bears against a partition 17, separating gas chamber 13 from the rest of tube 12. The rear end of tube 12 fits in the front casing block 18, whereas its front end passes through a barrel ring 19.

A sleeve 20 surrounds tube 12 and is pressed towards the front by a spring 21 which also surrounds tube 12. Associated with sleeve 20 there are control rods 22 and 23 which fit in appropriate grooves of casing 4.

In casing 4 are housed a moving breech 24 which carries a bolt 25, as well as a slide body 26. The rear part of the latter forms a stop 27 which is provided to cooperate with a striking hammer 28, pivotingly fitted to the trigger guard 11. A foregrip 29 bears against casing 4, surrounds tube 12 and extends beyond barrel ring 19.

The arrangements described so far are well known and are, for instance, described in Luxemburg Pat. No 67 882, to which reference is made for further detail.

According to the invention, the barrel 1 is a floating fit, so that in position of rest there remains an annular space 30 between breech 9 and casing 4 (FIG. 7). This annular space 30 is obtained by means of a washer 31, of steel for instance, which bears via an elastic stop 32 against a reinforcement and support tube 33 of moving barrel 1 foreward over a distance which corresponds to annular space 30.

On the other hand, the assembling of the weapon is carried out by means of a closing plug 34 which seals off aforesaid chamber 13 in the well known manner but which, in the present case, bears against foregrip 29.

The operation of the above-described weapon is illustrated by the diagram of FIG. 10. Three curves are shown, respectively describing the travel of barrel 1 as a function of time (curve A); of moving breech 24 (curve B) and of slide 26 (curve C).

Percussion takes place at the origin O. Subsequent to the rise in pressure, barrel 1 and breech 24—the latter taking slide 26 and the other parts of the mobile outfit with it—recoil by a distance which corresponds to the width of above-described annular space 30, until they abut casing 4. Barrel 1 and the mobile breech 24 rebound slightly whereas slide 26 pursues its course while being slightly restrained. It should be noted, that due to this first phase of recoil, the entire assembly of parts has reached a velocity of the order of magnitude of 4 m/sec, which is entirely transferred to slide 26, thus considerably facilitating the unlocking operation in the case of weak ammunition.

The slide then pursues its path in a phase of free recoil, the latter being intended to delay the unlocking as long as possible. This permits a relatively late opening of the weapon, thus reducing the fouling up of parts of the mechanism and improving safety.

In this example, the unlocking occurs after 12 mm of free recoil of slide 26, after which the operating cycle continues in the conventional manner.

The diagram of FIG. 10 was plotted with a caliber 12 weapon firing a cartridge (Federal Magnum) having 42 g of lead.

Lines a, b and c respectively show the beginning of the pressure rise, the maximum pressure and the issuing of the leads.

It can thus be seen, that the combination of a system with short recoil of the barrel with a system with gas tapping offers considerable advantages.

It must however be noted, that for certain shooting practices, one may be called upon to fire a large number of high power cartridges, and such within a relatively short space of time, which may cause a certain tiring of the marksman, considering he has to absorb a relatively strong recoil at each shot.

In order to be able to reduce this disadvantage as much as possible, the Applicant has suggested to fit the above-described weapon with a device permitting at any moment to lock the floating barrel, so that it may also be used as a sporting weapon with gas tapping only.

An example of such a practical form of embodiment is shown in FIGS. 11 to 16. The principle of the so-called supressible short recoil consists of substituting washer 31 of the first form of embodiment by two superposable washers 35 and 36, each of which is provided for this purpose with two protrusions 37 and 38 on their contact surfaces, having a length of about $(\pi/2)\cdot R$ (R being the average radius of aforesaid washers) and a height equal to one half of thickness d of annular space 30, joined to the surface of the respective disc by ramps 39. The geometry of the surfaces in contact of these two washers is consequently such, that by mere rotation of the one with respect to the other by one eighth of a turn, the superposed thickness z of the two washers can be reduced by a value corresponding to the thickness $x-y=d$ of annular space 30. In the example of the form of embodiment shown in FIG. 11, washer 35 is the rotating washer, whereas washer 36 is maintained in fixed position.

In order to permit the rotation by one eighth of a turn of washer 35 with respect to washer 36, without having to dismantle the foregrip 29 or any other part of the weapon, the foregrip 29 is provided at the level of washers 35 and 36 with a transverse hole 40 (FIG. 12) which gives access to a tongue 41 of washer 35.

After having slightly loosened magazine plug 34, it is possible by means of a sharp, pointed object, to rotate washer 35 by one eighth of a turn in the one sense or the other.

FIGS. 13 and 14 show the positions of tongue 41, and respectively of washers 35 and 36, which permit obtaining the short recoil of barrel 1 when firing. In this relative position of washers 35 and 36, the weapon operates simultaneously by gas tapping and by short recoil of the floating barrel, just as in the above-described form of embodiment.

FIGS. 15 and 16 show the positions of tongue 41, and respectively of washers 35 and 36, in relative positions which barrel 1 is blocked. In this position the weapon operates merely by gas tapping, the short recoil system thus being locked.

With a sporting weapon according to the second embodiment, the marskman can at any moment convert his weapon himself, without any tools whatever in accordance with the type of ammunition he intends using, or according to the shooting practice in which he is taking part.

It is obvious that the combination, in one single sporting weapon, of the gas tapping system and of the short recoil, whereby the short recoil can be suppressed at will, such as described and illustrated as example, may be provided in other weapons and in various forms.

The expression "sporting weapon" used in the present text is to be taken in the broadest possible sense, it covers all hunting guns as such, but also all other firearms used for sporting purposes.

What I claim is:

1. Automatic or semi-automatic sporting weapon of the gas operated type, comprising a casing, a magazine tube, a floating barrel with a barrel ring slidably embracing said magazine tube and a foregrip embracing said foregrip and barrel ring, the assembly being maintained by means of a sealing plug screwed into said magazine tube and bearing against one end of the foregrip, the other end of the latter bearing against said casing and whereby, in position of rest, a free annular space is provided between the rear end of the barrel, the breech and the corresponding part of the casing characterized by the fact that aforesaid free annular space is obtained by a washer which bears against said barrel ring and via an elastic stop, against a reinforcing and support tube fixed to the foregrip, whereby the width of said free annular space can be modified by adjusting said washer to lock or unlock said floating barrel.

2. Sporting weapon according to claim 1, characterized by the fact that aforesaid washer is made up of two individual superimposed washers, the geometry of the contact surfaces of said two washers being such, that by mere rotation of the one with respect to the other by one eighth of a turn, the height of the superpostion of the two washers may be reduced by a value corresponding to the whidth of said free annular space.

3. Sporting weapon according to claim 2, characterized by the fact that one of afore-mentioned washers is provided with a tongue for rotating that washer by one eighth of a turn with respect to the other fixed washer.

4. Sporting weapon according to claim 3, characterized by the fact that a transverse hole in the foregrip at the level of aforesaid washers provides access to said tongue.

* * * * *